US007516952B2

(12) United States Patent
Bittner et al.

(10) Patent No.: US 7,516,952 B2
(45) Date of Patent: Apr. 14, 2009

(54) FEEDER FOR A PUNCHING OF EMBOSSING APPARATUS AND METHOD OF OPERATING THE APPARATUS

(75) Inventors: Wolfgang Bittner, Brüggen (DE); Gerhard Klaassen, Mönchengladbach (DE); Peter Köpke, Düsseldorf (DE); Andre Pütz, Erkelenz (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 233 days.

(21) Appl. No.: 11/081,482

(22) Filed: Mar. 16, 2005

(65) Prior Publication Data

US 2005/0206066 A1 Sep. 22, 2005

(30) Foreign Application Priority Data

Mar. 16, 2004 (DE) ..... 10 2004 012 694

(51) Int. Cl.
*B65H 3/44* (2006.01)

(52) U.S. Cl. ..... 271/9.12; 271/9.13; 271/12

(58) Field of Classification Search ..... 271/9.12, 271/9.13, 9.01, 90, 6, 12; 83/277; 399/403
See application file for complete search history.

(56) References Cited

U.S. PATENT DOCUMENTS

| | | | | |
|---|---|---|---|---|
| 2,060,800 | A * | 11/1936 | Ehrig et al. | 271/93 |
| 2,146,945 | A * | 2/1939 | Ehrig et al. | 271/12 |
| 3,391,924 | A | 7/1968 | Schmidlin et al. | |
| 3,756,586 | A | 9/1973 | Craft | |
| 4,485,708 | A | 12/1984 | Halff et al. | |
| 5,154,689 | A * | 10/1992 | Modoux et al. | 493/342 |
| 5,570,172 | A | 10/1996 | Acquaviva | |

FOREIGN PATENT DOCUMENTS

| | | |
|---|---|---|
| DE | 1 816 425 | 6/1970 |
| DE | 28 02 596 A1 | 7/1979 |
| DE | 30 44 083 A1 | 9/1982 |
| DE | 37 01 603 A1 | 8/1988 |
| DE | 41 29 029 A1 | 3/1993 |
| DE | 42 18 788 A1 | 12/1993 |
| DE | 195 16 022 A1 | 11/1996 |
| DE | 195 16 073 A1 | 11/1996 |
| DE | 197 55 519 A1 | 6/1999 |
| DE | 101 41 964 A1 | 3/2003 |

(Continued)

OTHER PUBLICATIONS

Kipphan: "Handbook of Print Media", 2001 , Springer, Berlin, XP-002349141, ISBN: 3-540-67326-1, pp. 229-235.

(Continued)

*Primary Examiner*—Kaitlin S Joerger
(74) *Attorney, Agent, or Firm*—Laurence A. Greenberg; Werner H. Stemer; Ralph E. Locher

(57) ABSTRACT

A feeder is provided for a punching or embossing apparatus. The feeder has a configuration for feeding sheets from a multiplicity of stacks. The stacks are disposed next to one another in the transport direction. In a method for punching or embossing sheets using a punching or embossing apparatus, sheets are fed to the punching or embossing apparatus from stacks disposed next to one another.

27 Claims, 3 Drawing Sheets

FOREIGN PATENT DOCUMENTS

| | | | |
|---|---|---|---|
| DE | 102 16 134 | A1 | 10/2003 |
| EP | 0 976 673 | A2 | 2/2000 |
| EP | 1 074 496 | A1 | 2/2001 |
| GB | 2 340 109 | A | 2/2000 |

OTHER PUBLICATIONS

Eckhard: "Effizienz im Service", Verpackungsrundschau, 1999, XP-002375124, pp. D40 and D42 and English translation thereof.

* cited by examiner

FEEDER FOR A PUNCHING OF EMBOSSING APPARATUS AND METHOD OF OPERATING THE APPARATUS

BACKGROUND OF THE INVENTION

Field of the Invention

The invention relates to a feeder for a punching or embossing apparatus, and to a punching or embossing apparatus with a feeder of this type, and to a method for punching or embossing sheets using a punching or embossing apparatus.

Punching denotes cutting with intrinsically closed geometric blank shapes that can be circular, oval, polygonal and fantastical shapes of all types. The techniques practiced in print further processing, such as punching with hollow punches, knocking the corners off and punching registers, are also counted as belonging to this area. The punching is carried out against a punch overlay or against punches; in part, they are also shearing processes (see the reference titled "Druckweiterverarbeitung, Ausbildungsleitfaden für Buchbinder" [Print Further Processing, Training Guide For Bookbinders], Bundesverband Druck e.V. 1996, page 351 et seq.). Packaging material made from paper, paperboard or corrugated paperboard is usually punched in sheet format. During the punching process, however, groove lines or blind embossing can also additionally be introduced into the blank. This complex process makes it imperative that the sheets be punched individually, as the end products are usually sophisticated packaging. Punching dies with very low tolerances and extremely precisely and reliably functioning punching machines are required for optimum results.

The punching machines are frequently what are known as flat bed punches in which the printed sheets that are stacked on a pallet are fed to the punching machine. The sheets are aligned at three points with front and side guides with an accurate fit, transferred from a gripper carriage with a gripper bar and positioned exactly between the punching form and the punching plate. Here, the complete sheet is punched in one stroke; in the next station (a stripping station), the waste is removed by machine via stripping dies (see the reference titled "Stanzen und Faltschachtelkleben, Lösung für die Weiterverarbeitung" [Punching and Adhesively Bonding Folded Boxes, Solution for Further Processing], Heidelberger Druckmaschinen A G, 2003).

Most punching and embossing machines process large format products, for instance in a format up to 105×74 or 100×140. To a relatively small extent, small sheet formats (for example in the format 50×70) are also processed. In part, small punching or embossing machines are developed and used for smaller sheet formats or, as an alternative if investment in a small format machine is avoided, the small formats are processed on large machines. Although the latter case can be more economical than the purchase of a small format machine, the economy is nevertheless relatively low if a large format machine is used only for punching or embossing small format sheets.

SUMMARY OF THE INVENTION

It is accordingly an object of the invention to provide a feeder for a punching or embossing apparatus and a method of operating the apparatus that overcome the above-mentioned disadvantages of the prior art devices and methods of this general type.

With the foregoing and other objects in view there is provided, in accordance with the invention, a feeder for a punching or embossing apparatus. The feeder contains a device for feeding sheets from a multiplicity of sheet stacks. The sheet stacks are disposed next to one another in a transport direction.

It is therefore the object of the present invention to make the punching or embossing of small format sheets with a large format punching or embossing apparatus more economical and to increase the performance of a large format punching or embossing apparatus for small sheet formats.

The feeder according to the invention is therefore distinguished by the fact that a plurality of stacks are disposed next to one another in the transport direction, from which the feeder pulls sheets by a suitable device and feeds them to a punching or embossing apparatus. Here, the term feeder represents quite generally that apparatus which feeds sheets to the punching or embossing apparatus. The feeder according to the invention could also include two or more conventional, smaller format individual sheet feeders that are operated parallel to one another. In the context of the invention, this multiplicity of individual sheet feeders form only one feeder according to the invention, with the result that embodiments of this type are likewise covered by the invention.

As a result, the feeder can preferably pull sheets simultaneously from a plurality of stacks and feed them to the punching and embossing apparatus, although it can also be advantageous to pull the sheets from different stacks sequentially, in particular with regard to the refilling of the stacks from which the feeder pulls the sheets. The throughput of the punching or embossing apparatus can already be doubled by providing two stacks and given simultaneous removal of the sheets from the stacks and feeding them to the punching or embossing apparatus, with the result that high speeds per sheet can be achieved in this way, for example 14,000 sheets per hour. The performance of the punching apparatus is increased accordingly by the provision of three or more stacks from which the feeder takes the sheets simultaneously. In this way, therefore, the sheet throughput through the punching or embossing apparatus can be increased by a multiple with the same number of strokes of the punching or embossing apparatus.

In one advantageous refinement of the feeder according to the invention, the configuration for feeding sheets is configured in such a way that it is also possible to feed sheets from a single stack. In this way, the punching or embossing apparatus with the same feeder can also process those products which were originally intended to be processed using the punching or embossing apparatus of the corresponding format.

In a further advantageous embodiment of the feeder according to the invention, the configuration for feeding sheets has at least one suction separator per stack. Advantageously, the suction separator can be operated for each stack independently of the suction separators of the other stacks. In a further advantageous refinement of the feeder according to the invention, the configuration for feeding sheets has at least one independent suction head per stack, for attracting the uppermost sheet of the stack by suction. As a result, a feeder can be developed, which has only a common suction device across the entire feeder width.

In a further advantageous embodiment of the feeder according to the invention, the configuration for feeding sheets has at least one transport element assigned to the stack, in particular at least one transport belt, per stack. The transport elements advantageously have an independent drive for each stack. However, it is clear to the person skilled in the art that it is also possible to use a feeder with one transport element for all the sheets from the different stacks.

In a further advantageous refinement of the feeder according to the invention, the configuration for feeding sheets has at least one intermittently operated roller and/or one sheet flap per stack.

In a further advantageous refinement of the feeder according to the invention, the configuration for feeding sheets has at least one side guide per stack, for the lateral alignment of the respective sheets. The side guides advantageously likewise have an independent drive per stack for alignment. Furthermore, the side guides can advantageously be driven in such a way that the respective sheets of all the stacks are aligned laterally simultaneously.

In a further advantageous embodiment of the feeder according to the invention, the configuration for feeding sheets has at least one front guide per stack, for the alignment of the front side of the sheets. The front guides advantageously have an independent drive per stack for the alignment of the front side of the sheets. Furthermore, the front guides can advantageously be driven in such a way that the respective sheets of all the stacks are aligned simultaneously.

The invention likewise relates to a punching or embossing apparatus that has a feeder according to the invention having one, more than one or all of the preceding features. The punching or embossing apparatus advantageously has grippers on a gripper bar, for the transport of the sheets through the punching or embossing apparatus, the grippers and the gripper bar being configured in such a way that the grippers can be attached to the gripper bar variably. In this way, the gripper bar can be adapted, by the grippers which can be attached variably, to the majority of sheets which are fed from stacks arranged next to one another. In this way, it can also be advantageously achieved that the grippers can assume an ideal position with respect to the edges of the sheets. This can prevent the corners of the sheets from bending over during punching.

In one advantageous development of the punching or embossing apparatus, the punching or embossing apparatus has precision adjustment devices, each stack in the feeder being assigned a set of precision adjustment devices.

In a further advantageous refinement of the punching or embossing apparatus, the punching or embossing apparatus comprises a prestacking device that is configured in such a way that it is suitable for producing a plurality of aligned stacks on one pallet. In a particularly advantageous embodiment of the punching or embossing apparatus, the punching or embossing apparatus is a large format punching or embossing apparatus and the sheets are small format sheets, in particular a punching and embossing apparatus for a 105×74 format, and in particular the sheets being of 50×70 format.

Furthermore, the invention relates to a method for punching or embossing sheets using a punching or embossing apparatus. The method includes feeding sheets to the punching or embossing apparatus from stacks of sheets disposed next to one another in the transport direction, and punching the sheets that are fed from the stacks arranged next to one another.

In one development of the method according to the invention, the sheets from different stacks are punched simultaneously.

Other features which are considered as characteristic for the invention are set forth in the appended claims.

Although the invention is illustrated and described herein as embodied in a feeder for a punching or embossing apparatus and a method of operating the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
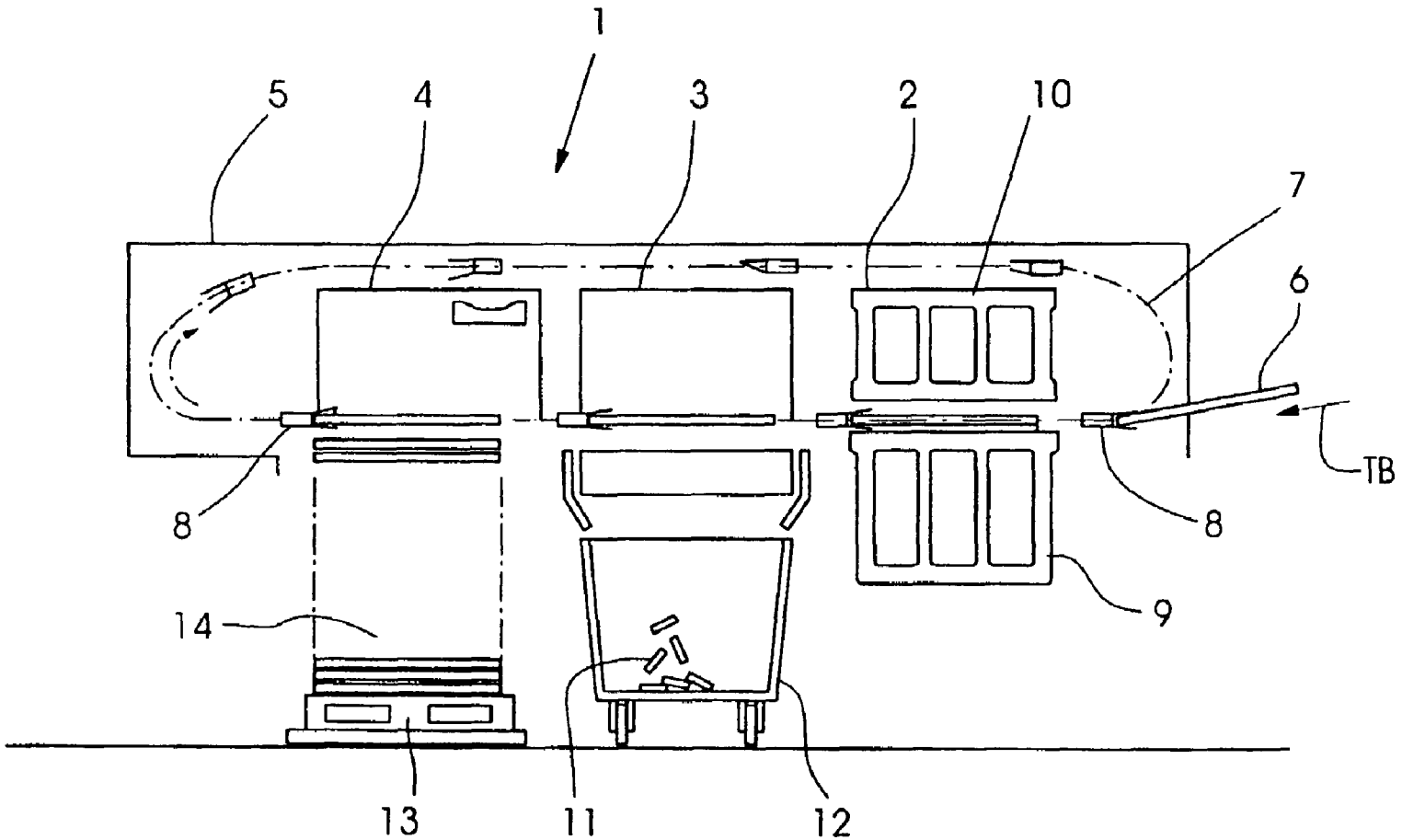
FIG. 1 is an illustration of a basic construction of a sheet punching and embossing machine.

Referring now to the figures of the drawing in detail and first, particularly, to FIG. 1 thereof, there is shown a diagrammatic illustration of a known punching or embossing apparatus 1. Here, as is also the case in the following figures, generally known drive and guide devices, cam disks and control devices which are required for the operation of the apparatus are not shown or are described only in general form, in order to clarify the methods of operation of the apparatus.

FIG. 1 shows the basic construction of a sheet punching and embossing machine 1 for punching, stripping and depositing sheets made from paper, paperboard and the like. The punching and embossing machine 1 contains a punching device 2, a stripping device 3 and a deposit device 4 which are supported and enclosed by a common machine housing 5.

The sheets 6 are gripped at their front edge by gripper bars 8 which are fastened to circulating chains 7, and are pulled intermittently through the various stations 2, 3 and 4 of the punching and embossing machine 1.

The punching station 2 contains an apparatus containing a lower table 9 and an upper table 10. The lower table 9 is mounted fixedly in the machine frame and is provided with a complementary plate to the punching blade. The upper table 10 is mounted such that it can be moved vertically and can be driven via a drive for the apparatus.

The gripper bar 8 transports the sheet 6 from the punching and embossing station 2 into the following stripping station 3, which can be equipped with stripping dies. In the stripping station 3, with the aid of the stripping dies, waste pieces 11 which are not required are expelled downward from the sheet, as a result of which the waste pieces 11 fall into a container-like carriage 12 which is pushed in under the station.

From the stripping station 3, the sheet 6 passes into the deposit station 4, where the sheet is either merely simply deposited or, more favorably, separation of the individual blanks takes place at the same time. The deposit station 4 can also contain a pallet 13 on which the individual sheets are stacked in the form of a stack 14, with the result that the pallets with the stacked sheets 14 can be moved away out of the region of the punching and embossing machine 1 after a specific stack height has been reached.

As can be seen, the chains 7 bear a plurality of gripper bars 8, for example there are eight here, with the result that a plurality of sheets 6 can be processed simultaneously in the various stations 2, 3 and 4.

Figure 2:
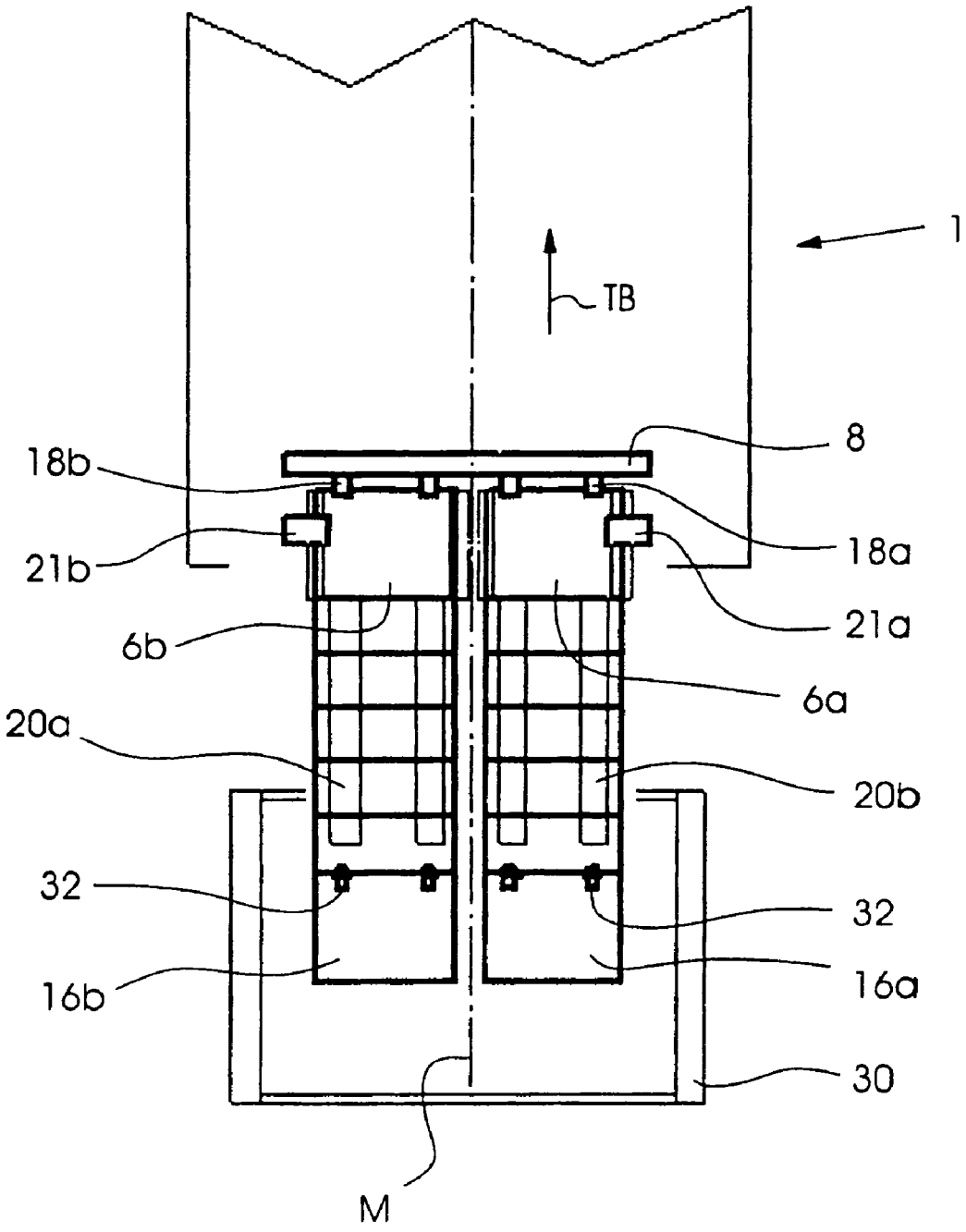
FIG. 2 is a diagrammatic, partial plan view of a feeder according to the invention.

In FIG. 1 and in FIG. 2, the transport movement of the sheets 6, 6*a*, 6*b* through the punching and embossing apparatus 1 is shown by the arrow with the designation TB. In the embodiment of the apparatus according to the invention shown in FIG. 2, a first stack 16*a* and, next to it, a second stack 16*b* are shown in a feeder 30. The two stacks 16*a*, 16*b* are shown symmetrically with respect to a centerline M of the feeder 30 and the punching or embossing apparatus 1. However, it is clear to a person of average skill in the art that, if required, he can also select a nonsymmetrical arrangement of the stacks 16*a*, 16*b*, for example if the two stacks 16*a*, 16*b* have different formats. Moreover, the feeder 30 is understood here as an apparatus which feeds sheets 6, 6*a*, 6*b* to the punching or embossing apparatus 1. The feeder 30 according to the invention could also contain two or more conventional, smaller format individual sheet feeders that are operated parallel to one another. In the context of the invention, however, only the feeder 30 according to the invention is understood here, with the result that embodiments of this type are likewise covered by the invention.

Figure 3:
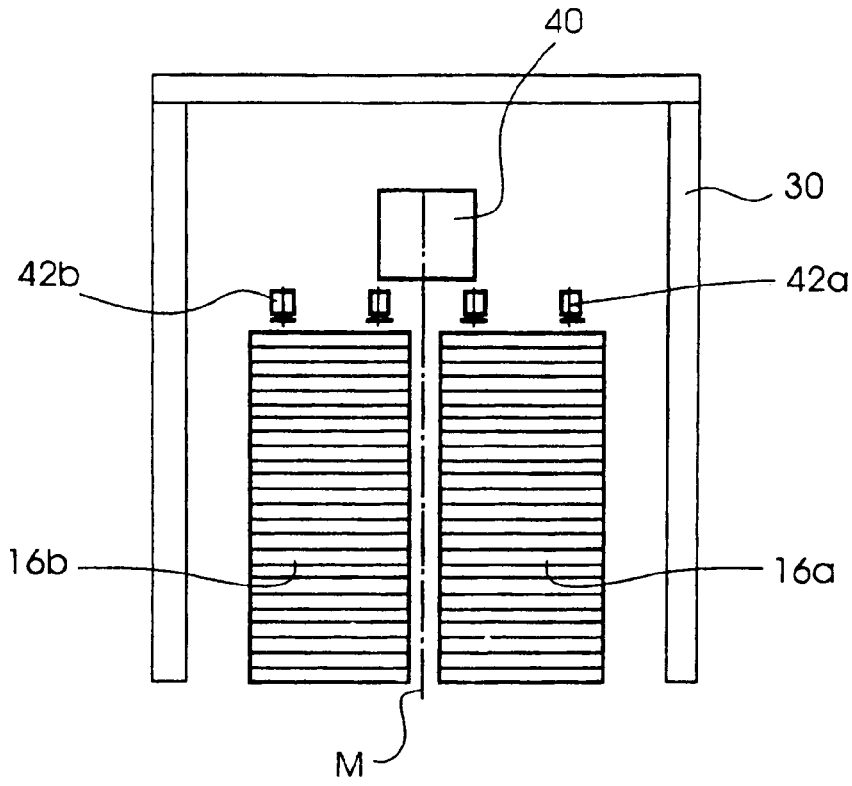
FIG. 3 is a diagrammatic, front view of a first embodiment of the feeder according to the invention.
Figure 4:
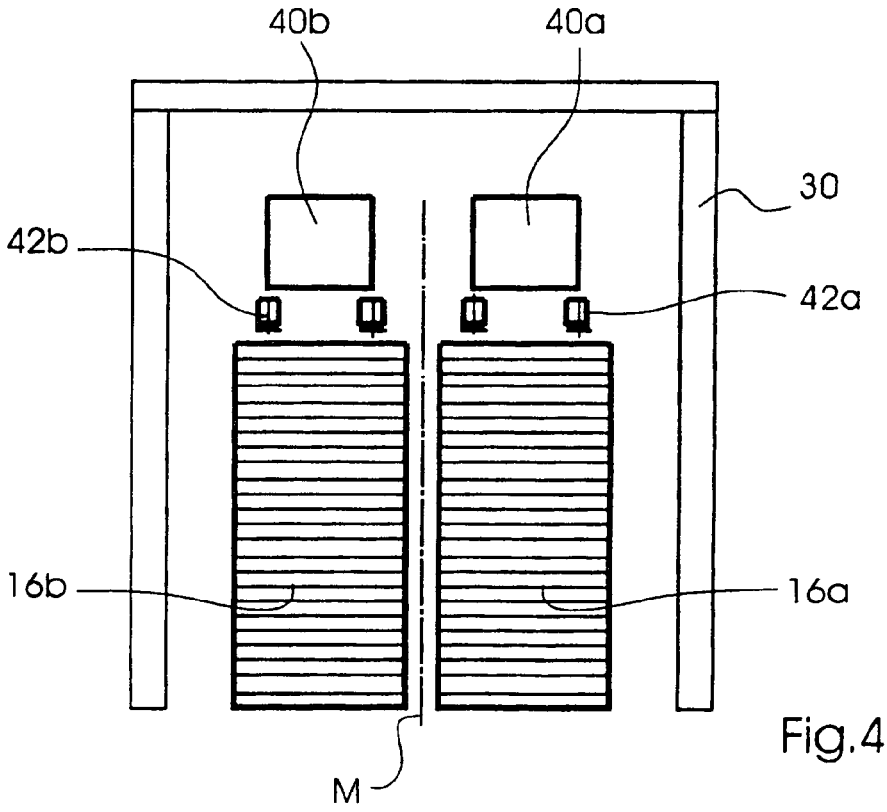
FIG. 4 is a diagrammatic, front view of a second embodiment of the feeder according to the invention.

As shown in FIG. 3 and FIG. 4, suction heads 42*a*, 42*b* are disposed at the upper end of the stack 16*a*, 16*b*. The suction heads 42*a*, 42*b* are connected to a suction device 40, 40*a*, 40*b*. This can be a common suction device 40 in one embodiment, as shown in FIG. 3, or in each case one suction device 40*a*, 40*b* which is assigned to the corresponding stack, as shown in the embodiment in FIG. 4. In the embodiment in FIG. 3, the suction heads 42*a*, 42*b* can be connected to the suction device 40 in such a way that the suction heads 42*a*, 42*b* are supplied with vacuum independently of one another. The suction device 40, 40*a*, 40*b* produces a suitable, synchronized vacuum at the suction heads 42*a*, 42*b*, with the result that the suction heads 42*a*, 42*b* can grip the uppermost sheet 6*a*, 6*b* of the stacks 16*a*, 16*b* and feed it to a transport device 20*a*, 20*b*. In the embodiments of FIGS. 3 and 4, each stack 16*a*, 16*b* is assigned in each case two suction heads 42*a*, 42*b*. However, it is clear to the person of average skill in the art that he can also use a different number of suction heads 42*a*, 42*b*, for instance one or three or more per stack.

Intermittently operated rollers 32 are disposed above the stacks 16*a*, 16*b*. The intermittently operated rollers 32 produce an overlapping stream of the sheets 6, 6*a*, 6*b* in the direction of the transport movement TB to the punching or embossing apparatus 1. The overlapping stream of the sheets 6, 6*a*, 6*b* is moved forward by pairs of transport belts 20. The pairs of transport belts are advantageously driven separately for each stack. However, there can also be provision for the transport belts 20 which are assigned to the respective stacks 16*a*, 16*b* to be synchronized with respect to one another by mechanical or electronic device.

Side guides 21*a*, 21*b* and non-illustrated front guides which are known to the person of average skill in the art are situated at the entrance of the punching or embossing apparatus 1 for the lateral alignment and the alignment of the front side of the sheets 6*a*, 6*b*. In one embodiment, the side guides 21*a*, 21*b* and front guides are assigned to the respective stacks 16*a*, 16*b* in such a way that they align the respective sheets 6*a*, 6*b* independently of one another. In a preferred embodiment, however, all the sheets that are subsequently to be punched together are aligned simultaneously.

After the sheets 6*a*, 6*b* have been aligned, they are gripped by grippers 18*a*, 18*b* which are attached to a gripper bar 8. Here, the grippers 18*a*, 18*b* are displaceably attached to the gripper bar 8, with the result that the position of the grippers 18*a*, 18*b* can be adjusted relative to the sheets 6*a*, 6*b*, so that suitable adaptation to the format and number of sheets 6*a*, 6*b* to be processed simultaneously is possible.

In one preferred embodiment of the punching or embossing apparatus 1, the punching or embossing apparatus 1 contains a non-illustrated stacking apparatus that produces the required number of stacks 16*a*, 16*b* on one pallet, which can then be used in the feeder 30.

This application claims the priority, under 35 U.S.C. § 119, of German patent application No. 10 2004 012 694.1, filed Mar. 16, 2004; the entire disclosure of the prior application is herewith incorporated by reference.

We claim:

1. An apparatus for punching and/or embossing, the apparatus comprising:

a feeder containing means for feeding sheets from a multiplicity of sheet stacks, the sheet stacks disposed next to one another at the same position in a transport direction, said means for feeding sheets having suction devices with at least one suction device for each of the sheet stacks, said suction devices being configured to operate independently from one another for each of the sheet stacks and pull the sheets sequentially from different ones of the stacks.

2. The feeder according to claim 1, wherein said means for feeding sheets has at least one independent suction head for each of the sheet stacks, for attracting an uppermost sheet of each of the sheet stacks by suction.

3. The feeder according to claim 1, wherein said means for feeding sheets has at least one transport element for each of the sheet stacks.

4. The feeder according to claim 3, wherein said transport element has an independent drive for each of the sheet stacks.

5. The feeder according to claim 1, wherein said means for feeding sheets has at least one intermittently operated roller for each of the sheet stacks.

6. The feeder according to claim 1, wherein said means for feeding sheets has side guides with at least one of said side guides for each of the sheet stacks, for the lateral alignment of the respective sheets.

7. The feeder according to claim 6, wherein said side guides have an independent drive for each of the sheet stacks for lateral alignment.

8. The feeder according to claim 6, wherein said side guides of all of the sheet stacks align the respective sheets simultaneously.

9. The feeder according to claim 1, wherein said means for feeding sheets has at least one front guide for each of the sheet stacks, for alignment of a front side of the sheets.

10. The feeder according to claim 3, wherein said transport element is a transport belt.

11. The apparatus according to claim 1, further comprising:

a gripper bar having grippers for transporting the sheets through the apparatus, said grippers being attached to said gripper bar in a variable manner.

12. The apparatus according to claim 1, further comprising a prestacking device configured for producing a plurality of aligned stacks on one pallet.

13. The apparatus according to claim 1, wherein the apparatus is a large format punching or embossing apparatus and the sheets are small format sheets.

14. The apparatus according to claim 13, wherein the apparatus is configured for a 105×74 format and the sheets being of a 50×70 format.

15. The apparatus according to claim 13, wherein the apparatus is a flat bed punching or embossing apparatus.

16. A method for punching or embossing sheets using a punching or embossing apparatus according to claim 1, which comprises the steps of:

feeding sheets to the punching or embossing apparatus from stacks of sheets disposed next to one another in a transport direction; and punching the sheets fed from the stacks disposed next to one another.

17. The method according to claim 16, which further comprises punching the sheets from the different stacks simultaneously.

18. An apparatus for punching and/or embossing, the apparatus comprising:

a feeder containing a device for feeding sheets from a multiplicity of sheet stacks, the sheet stacks disposed next to one another at the same position in a transport direction, said device for feeding sheets having suction devices with at least one suction device for each of the sheet stacks, said suction devices being configured to operate independently from one another for each of the sheet stacks and pull the sheets sequentially from different ones of the stacks.

19. The feeder according to claim 18, wherein said device has at least one independent suction head for each of the sheet stacks, for attracting an uppermost sheet of each of the sheet stacks by suction.

20. The feeder according to claim 18, wherein said device has at least one transport element for each of the sheet stacks.

21. The feeder according to claim 20, wherein said transport element has an independent drive for each of the sheet stacks.

22. The feeder according to claim 18, wherein said device has at least one intermittently operated roller for each of the sheet stacks.

23. The feeder according to claim 18, wherein said device has side guides with at least one of said side guides for each of the sheet stacks, for the lateral alignment of the respective sheets.

24. The feeder according to claim 23, wherein said side guides have an independent drive for each of the sheet stacks for lateral alignment.

25. The feeder according to claim 23, wherein said side guides of all of the sheet stacks align the respective sheets simultaneously.

26. The feeder according to claim 18, wherein said device has at least one front guide for each of the sheet stacks, for alignment of a front side of the sheets.

27. The feeder according to claim 20, wherein said transport element is a transport belt.

* * * * *